US005758824A

United States Patent [19]

Kuykendal et al.

[11] Patent Number: 5,758,824

[45] Date of Patent: Jun. 2, 1998

[54] METHOD AND APPARATUS FOR CREATING REVERSE RAINDROPS

[76] Inventors: Robert L. Kuykendal, 1136 Washington; Ronald S. Deichmann, 1135 Washington, both of St. Louis, Mo. 63101

[21] Appl. No.: 823,383

[22] Filed: Mar. 24, 1997

[51] Int. Cl.[6] ..... F21P 7/00

[52] U.S. Cl. ..... 239/12; 40/439; 40/442; 239/18; 239/193; 362/96

[58] Field of Search ..... 222/113, 420, 222/1; 239/12, 18, 20, 193, 23; 40/439, 442, 406, 407; 362/96, 806, 811

[56] References Cited

U.S. PATENT DOCUMENTS

| | | | |
|---|---|---|---|
| 2,726,116 | 12/1955 | Barber | 239/18 |
| 3,174,688 | 3/1965 | Chatten | 239/193 X |
| 4,265,402 | 5/1981 | Tsai | 239/20 |
| 4,294,406 | 10/1981 | Pevnick | 239/20 |
| 4,426,021 | 1/1984 | Rosenthal | 40/442 X |
| 5,069,387 | 12/1991 | Alba | 239/18 |
| 5,165,580 | 11/1992 | Rosenthal | 40/439 X |

*Primary Examiner*—Kevin P. Shaver

*Attorney, Agent, or Firm*—Henry H. Cummings

[57] ABSTRACT

Pressurized fluid enters by way of the flow control valve 90 which regulates flow and thus simulated raindrop size, through the fluid supply tube 80 and enters the fixed fluid distributor body 20, past a rotational seal 154 and into the rotating shaft 10, cushioned by the accumulator chamber 50. As the rotating shaft is made to rotate by means of the drive motor 60 and transmission means 70, the radial outlet port(s) 14 sequentially line up momentarily with each side port 26, allowing fluid flow through each outlet tube 30–35 in turn overflowing each respective conical vessel 40–45 to create a fluid drop at the lower point 48 which falls as simulated rain 160 in a desired three dimensional array. Each raindrop is thus timed perfectly according to the speed of rotation of the rotating shaft 10. The transducer 100 produces an electrical pulse for each rotation, also perfectly timed to the raindrops, which is input to the triggered oscillator 110 to ultimately control the strobe light 140. By means of the timing adjuster 120 the triggered oscillator can be sent to run at a faster frequency than the rotating shaft and thus the raindrops, so that each flash of the strobe light reveals individual raindrops 160 slightly earlier in their creation and falling cycle to create the illusion that the drops are falling upward.

16 Claims, 2 Drawing Sheets

METHOD AND APPARATUS FOR CREATING REVERSE RAINDROPS

I FIELD OF THE INVENTION

This invention relates to a fluid display which gives the appearance of raindrops rising from a collection container.

II BACKGROUND OF THE INVENTION

One known apparatus for producing raindrops which appear to rise instead of fall is a complicated apparatus which involves valves which must be replaced at approximately three month intervals. However the cost of valve replacement of this device makes it impractially expensive to operate.

U.S. Pat. No. 4,426,021 discloses creating the illusion in a beverage dispensing device of liquid droplets rising from a dringking glass while at the same time filling the drinking glass. U.S. Pat. No. 5,165,580 discloses a display device which creates illusions of water or other fluid in a solid stream with undulations, and/or droplets which rise, levitate or fall slowly. The illusions in these patents are created by oscillating the liquid and then applying a flashing light source at a frequency slightly greater, the same, or slightly less than the liquid oscillations.

However, in neither U.S. Pat. Nos. 4,426,021 or 5,165,580 is the speed of the flashing light source coupled to the speed of formation of the simulated solid stream or droplets which provides greater control of the simulated drops, and assures that the desired illusion will occur.

Also, neither of these patents provides a method and apparatus for obtaining a three dimensional array of raindrops, as is provided in the present invention.

III SUMMARY OF THE INVENTION

A. Objects

One object of the present invention is to provide a method and apparatus for making raindrops appear to rise instead of fall.

Another object of the present invention is to provide such a reverse fall appearing device which is inexpensive to operate on a sustained basis.

Another object of the present invention is to provide a method and apparatus for creating a reversal fall appearing device in which the the speed of the flashing light is controlled by the speed of formation of the simulated drops to achieve improved reliability and control over the simulated rise, levitation or fall of fluid.

Another object is to provide a three dimensional array of raindrops.

Other objects will be apparent from the following Description and Drawings.

B. Summary

Pressurized fluid enters by way of the flow control valve 90 which regulates flow and thus simulated raindrop size, through the fluid supply tube 80 and enters the fixed fluid distributor body 20, past a rotational seal 154 and into the rotating shaft 10, cushioned by the accumulator chamber 50. As the rotating shaft is made to rotate by means of the drive motor 60 and transmission means 70, its radial outlet port(s) 14 sequentially line up momentarily with each side port 26, allowing fluid flow through each outlet tube 30–35 in turn overflowing each respective conical vessel 40–45 to create a fluid drop at the lower point 48 which falls as simulated rain 160 in a desired three dimensional array. Each raindrop is thus timed perfectly according to the speed of rotation of the rotating shaft 10. The transducer 100 produces an electrical pulse for each rotation, also perfectly timed to the raindrops, which is input to the triggered oscillator 110 to ultimately control the strobe light 140. By means of the timing adjuster 120 the triggered oscillator can be sent to run at a faster frequency than the rotating shaft and thus the raindrops, so that each flash of the strobe light reveals individual raindrops 160 slightly earlier in their creation and falling cycle to create the illusion that the drops are falling upward.

IV THE DRAWINGS

V DESCRIPTION OF PREFERRED EMBODIMENTS

Figure 1:
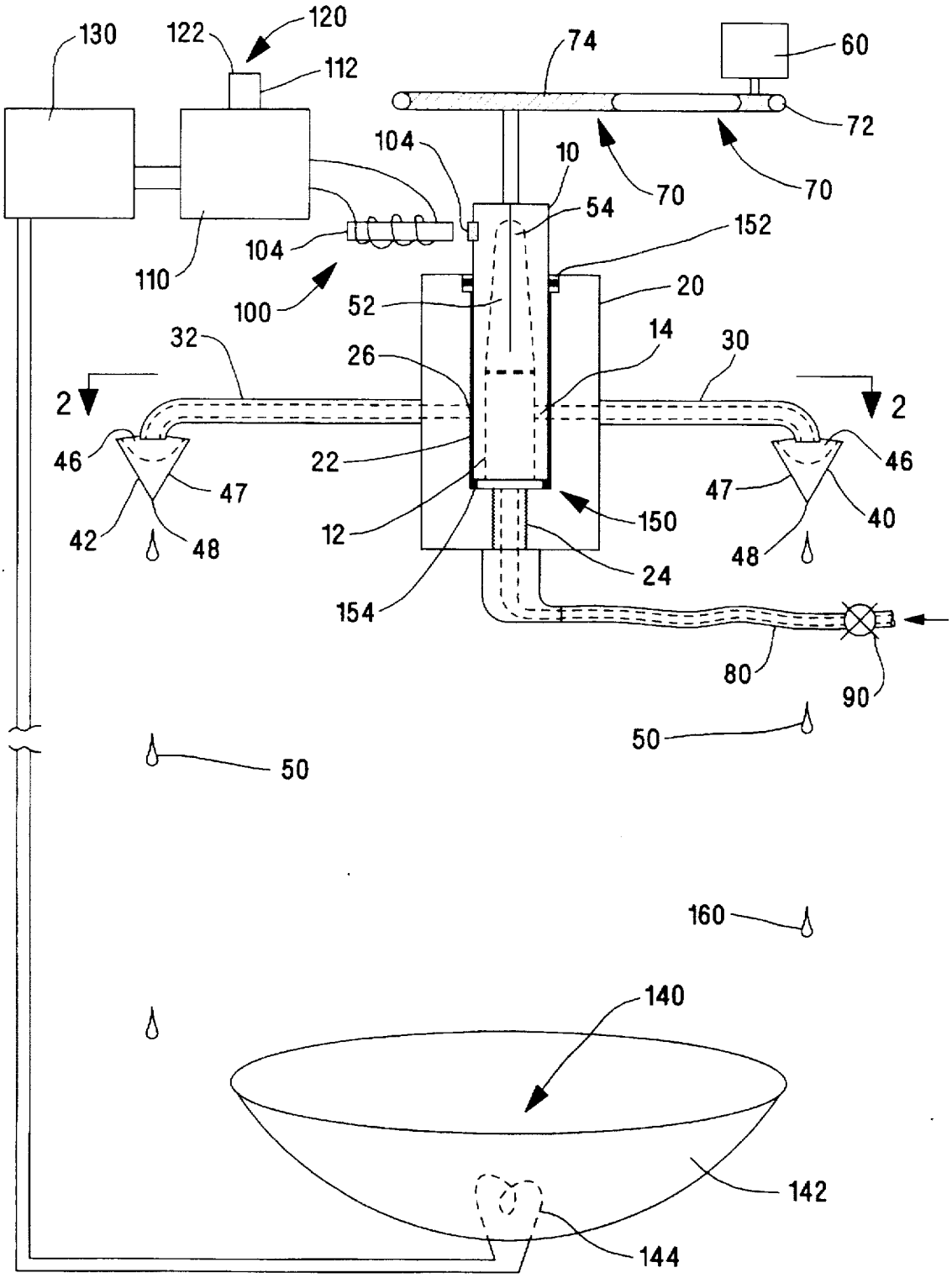
FIG. 1 is a schematic perspective front elevation view of the method and apparatus of the present invention.
Figure 2:
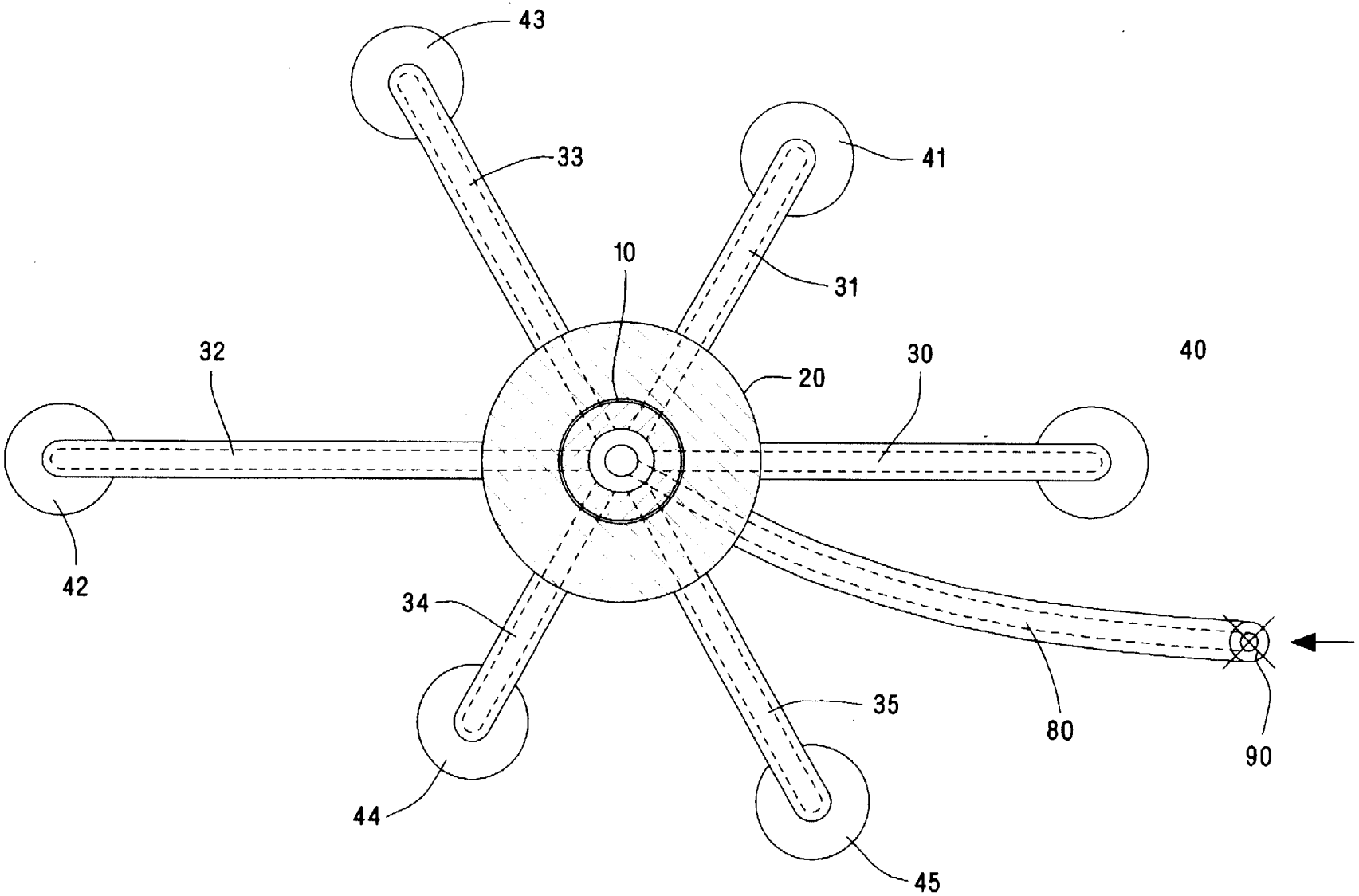
FIG. 2 is a horizontal sectional view looking in the direction of the arrows along the line 2—2 in FIG. 1.

In accordance with the present invention, a rotating shaft 10 made of corrosion resistant meterial such as metal or strong plastic which is partially hollow, includes an axial inlet port 12 at one end and one or more radial outlet ports 14.

A fluid distributor body 20 also made of corrosion resistant material such as metal or strong plastic with a cylindrical cavity 22 surrounds the rotating shaft and includes a fluid inlet port 24 at one end to line up with the inlet port 12 of the rotating shaft 10 and whenever the shaft 10 is made to rotate, the inlet ports 12, 24 always line up but the outlet ports 14, 26 only line up momentarily, once per revolution.

One or more outlet tubes 30–35 also made of corrosion resistant materila such as metal or strong plastic are firmly mounted in the fluid distributor body 20 to connect with the side ports 26 to conduct fluid from the rotating shaft 10 into individual conical vessels 40–45. The length and direction of each individual outlet tube 30–35 is set to create a pleasing three dimensional array of the resulting simulated rain.

One or more of the conical vessels 40–45 also made of corrosion resistant material such as metal or strong plastic are mounted on the outlet end of each respective outlet tube 30–35. Each conical vessel 40–45 is mounted with its open end 46 level and upward to contain some measure of fluid such that, whenever fluid is made to pulse out from the outlet tubes 30–35 by means of the rotation of the rotating shaft 10 it will overflow the conical vessels 40–45 and adhere to the outer surface 47, flow downward toward the point 48, form into a drip 50 and fall downward as simulated rain in a variety of desired three dimensional arrays by appropriate location of conical vessels 40–45. By use of these conical vessels, the size of the resulting simulated raindrops can be controlled by controlling the rate of flow into and through the rotating shaft 10 by means of the inlet tube 80 and the flow control valve 90.

An accumulator chamber 52 comprising a cushion of trapped air 54 is provided to allow a more or less continual inlet flow of fluid into the axial port 12 of the rotating shaft 10 to match the side port (s) 26 of the fluid distributor body 20 created by rotation of the rotating shaft 10. This accumulator chamber may be located within the rotating shaft 10 as shown, or elsewhere as a separate chamber (not shown) along the inlet flow path of the fluid.

A drive motor 60 is provided with a fixed or adjustable variable speed for rotating the rotating shaft 10. For example, the shaft may rotate at 800–1000 rpm.

A transmission means 70 is provided comprising a pulley 72, and one or more gears 74 or other means for matching the speed and torque of tine drive motor 60 with the optimal speed of the rotating shaft 10.

A fluid supply conduit 80 made of corrosion resistant material such as metal or strong plastic is provided for connecting the flow control valve means 90 with the axial port 12 of the rotating shaft 10.

The flow control valve means 90 controls the rate of fluid flow from the fluid source into the fluid supply tube 80 and thus controlling the size of the simulated rain drops 50 ultimately produced at the conical vessels 40–45. An example of a suitable valve means is a ½ inch ball valve.

A transducer means 100 is provided comprising, for example, a permanent magnet 102 affixed to the rotating shaft 10 and a stationary pickup coil 104 mounted in close proximity so as to produce an electrical pulse which corresponds to each rotation of the rotating shaft 10.

A triggered oscillator means 110 is provided comprising a known triggered oscillator circuit 112 which generates a regular output pulse at some frequency related to and controlled by an input pulse received from the transducer 100. The relationship of this output pulse frequency to the frequency of the input pulse from the transducer is controlled by means of the timing adjuster 120.

An accumulator chamber 52 comprising a cushion of trapped air 54 is provided to allow a more or less continual inlet flow of fluid into the axial port 12 of the rotating shaft 10 to match the side port (s) 26 of the fluid distributor body 20 created by rotation of the rotating shaft 10. This accumulator chamber may be located within the rotating shaft 10 as shown, or elsewhere as a separate chamber (not shown) along the inlet flow path of the fluid.

A drive motor 60 is provided with a fixed or adjustable variable speed for rotating the rotating shaft 10. For example, the shaft amu rotate at 800–100 rpm.

A transmission means 70 is provided comprising a pulley 72, and one or more gears 74 or other means for matching the speed and torque of the drive motor 60 with the optimal speed of the rotating shaft 10.

A fluid supply conduit 80 made of corrosion resistant material such as metal or strong plastic is provided for connecting the flow control valve means 90 with the axial port 12 of the rotating shaft 10.

The flow control valve means 90 controls the rate of fluid flow from the fluid source into the fluid supply tube 80 and thus controlling the size of the simulated rain drops 50 ultimately produced at the conical vessels 40–45. An example of a suitable valve means is a ½ inch ballvalve.

A transducer means 100 is provided comprising, for example, a permanent magnet 102 affixed to the rotating shaft 10 and a stationary pickup coil 104 mounted in close proximity so as to produce an electrical pulse which corresponds to each rotation of the rotating shaft 10.

A triggered oscillator means 110 is provided comprising, a known triggered oscillator circuit 112 which generates a regular output pulse at some frequency related to and controlled by an input pulse received from the transducer 100. The relationship of this output pulse frequency to the frequency of the input pulse from the transducer is controlled by means of the timing adjuster 120.

The timing adjuster means 120 comprises, for example, an adjustable resistance or impedance means 122 for example of 300 ohms to control the output frequency of the triggered oscillator 110.

A high voltage power supply means 130 of for example 10,000 Volts is provided which receives the output pulse from the triggered oscillator 110 to fire the strobe light means 140.

The strobe light means 140 includes a focusing reflector 142 made of silvered plastic or metal, which comprises of one or more light sources 144 for high intensity, short duration light pulses, aimed and focused at the simulated raindrops, controlled by the high voltage power supply means 130 and fired under control of the triggered oscillator means 110.

Fluid is confined within the fluid distributor body 20 and the rotating shaft 10 by means of one or more rotational seals means 150 made for example of elastormeric material and preferably comprising an upper seal 152 and a lower seal 154.

In the operation of the present invention, pressurized fluid enters by way of the flow control valve 90 which regulates flow and thus simulated raindrop size, through the fluid supply tube 80 and enters the fixed fluid distributor body 20, past a rotational seal 154 and into the rotating shaft 10, cushioned by the accumulator chamber 50.

As the rotating shaft is made to rotate by means of the drive motor 60 and transmission means 70, its radial outlet port(s) 14 sequentially line up momentarily with each side port 26, allowing fluid flow through each outlet tube 30–35 in turn overflowing each respective conical vessel 40–45 to create a fluid drop at the lower point 48 which falls as simulated rain 160. Each raindrop is thus timed perfectly according to the speed of rotation of the rotating shaft 10.

The transducer 100 produces an electrical pulse for each rotation, also perfectly timed to the raindrops, which is input to the triggered oscillator 110 to ultimately control the strobe light 140. By means of the timing adjuster 120 the triggered oscillator can be sent to run at a faster frequency than the rotating shaft and thus the raindrops, so that each flash of the strobe light reveals individual raindrops 160 slightly earlier in their creation and falling cycle to create the illusion that the drops are falling upward.

What is claimed is:

1. Apparatus for generating drops of water, simulated raindrops or other fluid and illuminating them with short duration bursts of light in a manner to create the illusion to defy gravity and to travel upwards comprising:

a rotating shaft which is partially hollow, including at a first end an axial inlet port, and at least one radial outlet port;

a fluid distributor body having a cylindrical cavity surrounding said rotating shaft and including at a first end a fluid inlet port which aligns with said axial inlet port, and a distributor outlet port, whereby when said shaft is made to rotate, said axial inlet port and said fluid inlet port always line up but said radial outlet port: and said distributor outlet port only line up momentarily, once per revolution;

at least one outlet tube mounted in said fluid distributor body to connect with said radial outlet port to conduct fluid from said rotating shaft into at least one conical vessel;

said conical vessel mounted on the outlet end of said outlet tube;

said conical vessel mounted with its open end level and upward to contain fluid whereby whenever fluid is made to pulse out from said outlet tube by means of rotation of said rotating shaft, said fluid overflows said conical vessel and adheres to a conical vessel outer surface, flows downward toward a conical vessel low point, form into a drop and falls downward as simulated rain;

drive means for rotating said rotating shaft;

transmission means for matching the speed and torque of said drive means with the speed of said rotating shaft;

a fluid supply conduit means containing a flow control valve means which connects with said axial port; and whereby the size of the resulting simulated raindrops can be controlled by controlling the rate of flow into and through said rotating shaft by means of said flow control valve means located within said fluid inlet tube;

a transducer means to produce an electrical pulse which corresponds to each rotation of said rotating shaft.

a triggered oscillator means which generates a regular output pulse at a frequency related to and controlled by an input pulse received from said transducer means;

timing adjuster means which controls the relationship of this output pulse frequency to the frequency of the input pulse from said transducer means controlled by means of the timing adjuster;

high voltage power supply means which receives the output pulse from the triggered oscillator means;

and a flashing light means including a focusing reflector which comprises at least one light source for high intensity, short duration light pulses, aimed and focused at the simulated raindrops, controlled by the high voltage power supply means, and fired under control of the triggered oscillator means.

2. Apparatus according to claim 1 including an accumulator chamber comprising a cushion of trapped air to allow a continual inlet flow of fluid into said axial port.

3. Apparatus according to claim 2 wherein said accumulator chamber is located within said rotating shaft.

4. Apparatus according to claim 2 wherein said transducer means comprises a permanent magnet affixed to said rotating shaft and a stationary pickup coil mounted in close proximity to said magnet.

5. Apparatus according to claim 4 wherein fluid is confined within said distributor body and said rotating shaft by means of rotational seal means.

6. Apparatus according to claim 5 wherein said seal means comprise an upper seal and a lower seal.

7. A method for generating drops of water, simulated raindrops or other fluid and illuminating them with shore duration bursts of light in a manner to create the illusion to defy gravity and to travel upwards comprising:

rotating a shaft which is partially hollow, including at a first end an axial inlet port, and at least one radial outlet port;

locating a fluid distributor body having a cylindrical cavity surrounding said rotating shaft and including at a first end a fluid inlet port which aligns with said axial inlet port, and a distributor outlet port, whereby when said shaft is made to rotate, said axial inlet port and said fluid inlet port always line up but said radial outlet port and said distributor outlet port only line up momentarily, once per revolution;

mounting a plurality of outlet tubes in said fluid distributor body to connect with said radial outlet port to conduct fluid from said rotating shaft into aplurality of conical vessels;

locating said conical vessels on the respective outlet ends of said outlet tubes locating said conical vessels with their open end level and upward to contain fluid;

forcing fluid to pulse out from said outlet tubes by means of rotation of said rotating shaft, whereby said fluid overflows said conical vessels and adheres to a conical vessel outer surface, flows downward toward a conical vessel low point, forms into a drop and falls downward as simulated rain;

rotating said shaft with drive means;

matching the speed and torque of said drive means with the speed of said rotating shaft with transmission means;

providing fluid supply conduit means containing a flow control valve means which connects with said axial port; and controlling the size of the resulting simulated raindrops by controlling the rate of flow into and through said rotating shaft by means of said flow control valve means located within said fluid inlet tube to obtain simulated rain in a three dimensional array.

8. A method according to claim 7 including producing an electrical pulse which corresponds to each rotation of said rotating shaft with a transducer means;

generating a regular output pulse at a frequency related to and controlled by an input pulse received from said transducer means with a triggered oscillator means, controling the relationship of said output pulse frequency to the frequency of the input pulse from said transducer means by means of a timing adjuster means;

connecting high voltage power supply means which receives said output pulse from said triggered oscillator means;

providing a flashing light means including a focusing reflector which comprises at least one light;

providing high intensity, short duration light pulses; and aiming and focusing said pulses at said simulated raindrops.

9. A method according to claim 7 including providing an accumulator chamber; trapping air in said accumulator to provide a cushion of trapped air, and allowing a continual inlet flow of fluid into said axial port.

10. A method according to claim 9 including locating said accumulator chamber within said rotating shaft.

11. A method according to claim 8 including affixing a permanent magnet affixed to said rotating shaft and locating a stationary pickup coil in close proximity to said magnet.

12. A method according to claim 10 including confining fluid within said distributor body and said rotating shaft by means of rotational seal means.

13. Apparatus for generating drops of water, simulated raindrops or other fluid comprising:

a rotating shaft which is partially hollow, including at a first end an axial inlet port, and at least one radial outlet port;

a fluid distributor body having a cylindrical cavity surrounding said rotating shaft and including at a first end a fluid inlet port which aligns with said axial inlet port, and a distributor outlet port, whereby when said shaft is made to rotate, said axial inlet port and said fluid inlet port always line up but said radial outlet port and said distributor outlet port only line up momentarily, once per revolution;

plurality of outlet tubes mounted in said fluid distributor body to connect with said radial outlet port to conduct fluid from said rotating shaft into a plurality of conical vessels located in a three dimensional array;

said conical vessels mounted on the outlet end of said outlet tubes; said conical vessels mounted with their open end level and upward to contain fluid whereby whenever fluid is made to pulse out from said outlet tube by means of rotation of said rotating shaft, said fluid overflows said conical vessels and adheres to a conical vessel outer surface, flows downward toward a conical vessel low point, forms into a drop and falls downward as simulated rain in a three dimensional array;

drive means for rotating said rotating shaft;

transmission means for matching the speed and torque of said drive means with the speed of said rotating shaft;

a fluid supply conduit means containing a flow control valve means which connects with said axial port; and whereby the size of the resulting simulated raindrops can be controlled by controlling the rate of flow into and through said rotating shaft by means of said flow control valve means located within said fluid inlet tube.

14. Apparatus according to claim 13 wherein said outlet tubes extend radially outwardly torn said distributor body.

15. Apparatus according to claim 14 wherein some of said outlet tubes extend a different distance outwardly then do other of said outlet tubes.

16. Apparautus according to claim 15 wherein some of said conical vessels are vertically spaced from other conical vessels.

* * * * *